US008485315B2

(12) United States Patent
Krishnamoorthy et al.

(10) Patent No.: US 8,485,315 B2
(45) Date of Patent: Jul. 16, 2013

(54) ACOUSTIC ENERGY REFLECTOR

(75) Inventors: Sasikumar Krishnamoorthy, Kochi (IN); Manoj Nalanda Rajagopalan, Kochi (IN); Gopalan Suresh Nair, Kochi (IN); Mukundan Thekkekara, Kochi (IN)

(73) Assignee: Defence Research & Development Organisation Ministry of Defence, New Delhi (IN)

( * ) Notice: Subject to any disclaimer, the term of this patent is extended or adjusted under 35 U.S.C. 154(b) by 84 days.

(21) Appl. No.: 13/255,834

(22) PCT Filed: Jun. 24, 2010

(86) PCT No.: PCT/IB2010/001543

§ 371 (c)(1), (2), (4) Date: Nov. 29, 2011

(87) PCT Pub. No.: WO2010/150090

PCT Pub. Date: Dec. 29, 2010

(65) Prior Publication Data

US 2012/0118665 A1 May 17, 2012

(30) Foreign Application Priority Data

Jun. 25, 2009 (IN) ..... 1310/DEL/2009

(51) Int. Cl.

| | |
|---|---|
| ***E04B 1/84*** | (2006.01) |
| ***E04B 1/82*** | (2006.01) |
| *E04B 1/74* | (2006.01) |

(52) U.S. Cl.

USPC ..... 181/294; 181/290; 181/288

(58) Field of Classification Search

USPC ..... 181/294, 295, 290, 286, 285, 284, 181/176, 288, 292

See application file for complete search history.

(56) References Cited

U.S. PATENT DOCUMENTS

| | | | | |
|---|---|---|---|---|
| 3,021,504 | A | | 2/1962 | Toulis |
| 3,756,345 | A | | 9/1973 | D'Amico et al. |
| 3,901,352 | A | | 8/1975 | Cluzel |
| 4,090,171 | A | | 5/1978 | Bulmer et al. |
| 4,126,847 | A | | 11/1978 | Etkins |
| 4,197,920 | A | | 4/1980 | Cluzel et al. |
| 4,237,176 | A | * | 12/1980 | Brueggemann et al. ..... 428/212 |
| 4,399,526 | A | * | 8/1983 | Eynck ..... 367/149 |
| 4,734,323 | A | * | 3/1988 | Sato et al. ..... 428/317.3 |
| 4,754,441 | A | | 6/1988 | Butler |
| 4,940,112 | A | * | 7/1990 | O'Neill ..... 181/290 |
| 4,982,385 | A | | 1/1991 | Eynck |
| 5,099,457 | A | | 3/1992 | Giannotta et al. |
| 5,438,171 | A | * | 8/1995 | Schmanski ..... 181/210 |

(Continued)

OTHER PUBLICATIONS

International Search Report issued in Application No. PCT/IB2010/001543; Dated Nov. 4, 2010.

(Continued)

*Primary Examiner* — Edgardo San Martin
(74) *Attorney, Agent, or Firm* — Oliff & Berridge, PLC

(57) ABSTRACT

The present invention relates to an acoustic energy reflector comprising a microcellular rubber as inner liner and a fiber reinforced composite as outer casing, in a core-shell assembly, wherein the said microcellular rubber is selected from the group of natural and synthetic rubbers having glass transition temperature below 0° C. and the resin for the fiber reinforced composite is selected from a group having a glass transition temperature at least 50° C.

16 Claims, 4 Drawing Sheets

U.S. PATENT DOCUMENTS

| | | | | |
|---|---|---|---|---|
| 5,536,910 | A * | 7/1996 | Harrold et al. | 181/290 |
| 5,764,782 | A | 6/1998 | Hayes | |
| 6,614,143 | B2 | 9/2003 | Zhang et al. | |
| 7,364,014 | B2 * | 4/2008 | Goda et al. | 181/293 |
| 7,601,654 | B2 * | 10/2009 | Bhatnagar et al. | 442/135 |
| 7,973,106 | B2 * | 7/2011 | Fisk et al. | 524/556 |
| 8,051,947 | B2 * | 11/2011 | Karayianni | 181/207 |
| 8,132,643 | B2 * | 3/2012 | Berker et al. | 181/210 |
| 8,292,214 | B2 * | 10/2012 | Lin et al. | 244/1 N |
| 2007/0020447 | A1 | 1/2007 | Yamaguchi et al. | |
| 2009/0065299 | A1 * | 3/2009 | Vito et al. | 181/294 |
| 2009/0250293 | A1 * | 10/2009 | Gleine et al. | 181/292 |
| 2009/0277716 | A1 * | 11/2009 | Eadara et al. | 181/290 |
| 2010/0051380 | A1 * | 3/2010 | Dohring et al. | 181/290 |

OTHER PUBLICATIONS

Written Opinion of the International Searching Authority issued in Application No. PCT/IB2010/001543; Dated Nov. 4, 2010.

* cited by examiner (a) (b)

ACOUSTIC ENERGY REFLECTOR

FIELD OF INVENTION

The present invention relates to an acoustic energy reflector. More particularly, the said acoustic energy reflector generates, radiates and receives acoustic energy at various frequencies, particularly in sonar applications. The said acoustic energy reflector has been made of fiber reinforced composite, and installed in under water. The said acoustic energy reflector is capable to be used alone or as an attachment to any transducer set up for achieving directionality of acoustic transducer.

BACKGROUND AND PRIOR ART

It is known that underwater acoustic transducers are used extensively both in military and civil applications. The majority of these transducers are based on the use of piezoelectric and electrostrictive materials as the active material in the transducer with functions of acoustic signal detectors, resonators, acoustic projectors and ultrasonic imaging. Typical civil applications include oceanographic survey, geographical exploration, depth sounding and fish finding, whereas in military they are used in active sonar, obstacle avoidance, mine hunting, underwater communication etc.

In the case of sonar applications, the transducer is a reciprocal device, such that when electricity is applied to the transducer, a pressure wave is generated in water, and when a pressure wave impinges on the transducer, electricity is developed. The transducer may be employed as a transmitting device (projector), a listening device (hydrophone), or both. Depending on various applications, several designs of projectors and hydrophones are available in patents and commercially.

Most of the transducers are omni directional in performance and directionality is by and large obtained by two methods. One is by the modification of the driver as explained, for example, in U.S. Pat. Nos. 4,754,441 and 6,614,143. The first patent describes the use of multiple curved shells driven by a ring or corresponding number of attached piezoelectric or magnetostricitive type rod or bar drivers which together take on the form of regular polygon. The second patent explain the complicated design of an electro active device with first and second electro active substrates each having first and second opposed continuous planar surfaces wherein each of the first opposed surfaces have a polarity and each of the opposed surfaces have an opposite polarity. For many of the common purposes, such complicated design aspects of the electro active driver may be avoided by a simple yet novel technique.

The other less tedious and less complex method is by the use of acoustic reflectors. It is necessary to utilize walls which reflect sound waves in a number of devices. The surface of separation between two materials having different acoustic impendence is known to form a good acoustic reflector. Water has relatively high acoustic impedance, while many light materials such as gas, cork, or cellular material have impedance much lower than water and have therefore been used for submerged reflectors. Some of the material that are used in the present context include celtite and corprene, and some specialized elastomers marketed under trade names familiar in the art. A plurality of apparatus has been employed in the past in a series of similar applications. For example, U.S. Pat. No. 3,756,345 explains the use of precompressed balsa wood as acoustic reflector or decoupler providing excellent insertion loss. A reflector made of a stack of metallic mesh members mounted between two rigid plates made of stratified synthetic resin within an enclosure is detailed in U.S. Pat. No. 3,901,352. This however, needs an intricate design of intermeshing of high modulus filaments.

In U.S. Pat. No. 4,090,171, an underwater acoustic reflector for use at elevated hydrostatic pressures comprising a plurality of thin paper laminate assembled in an integrated stack enclosed by a thin-walled gas confining wrapping, and a waterproof jacketing has been described, however requiring a plurality of materials and assembly methods. Even the use of electrochemistry to produce bubbles by using electrodes and aqueous electrolyte solution, which forms a reflective surface, has been specified in U.S. Pat. No. 4,197,920. Apparently, this necessitates for electrodes and a constant supply of current for its use as a reflector, which may not be suitable for the aforesaid applications. The use of hollow gas-filled sphere in the production of corner reflectors of passive acoustic navigation aid is noted in U.S. Pat. No. 4,126,847, which would require the intricate requisite for gas filled spherical membranes arranged over three substantially mutually perpendicular surfaces, as in a corner reflector. Another patent explains the use of inactive ceramic coating to induce directionality (U.S. Pat. No. 4,754,441). Various acoustic decouplers in the past have been designed to provide, in conjunction with a signal conditioning plate, the proper impedance backing for one or more hydrophones included in the array and to isolate or decouple structure borne noise as explained in patent by Eynck (U.S. Pat. No. 4,982,385). In U.S. Pat. No. 5,099,457, details are given about an acoustic wave reflector capable of working under deep submersion using a sheet of air set up between a reflecting plate and a perforated plate and having a rubber bladder which, under the effect of the pressure of the water, feeds the sheet of air through the perforated plate.

A Flextentional transducer (FT) has been made directional using a plurality of wells in U.S. Pat. No. 5,764,782. While many of the prior art reflectors are exceptionally efficient, many of the acoustic reflecting material used heretofore or complicated and tedious to fabricate or may not retain there desirable reflecting properties at elevated hydrostatic pressure. Most of the widely used reflecting materials are viscoelastic polymers in micro cellular form or that containing hard, air-encapsulated bubble like materials. Hence, it was observed that desirable low pressure acoustic properties of many of them are often severely impaired after they are subjected to high hydrostatic pressure. Moreover, this function becomes even more difficult as one resort to lower frequencies of operation. The Inventors hereof have recognized the need for acoustic reflector that can easily fabricated with readily available material, but that will undergo performance degradation with increasing hydrostatic pressure or water absorption, such a material or device will have great implications in sonar used for both civil and military operations.

OBJECTIVES OF THE INVENTION

The primary objective of the present invention is to provide an acoustic energy reflector to generate, radiate and receive acoustic energy at various frequencies.

Another objective of the present invention is to provide an acoustic energy reflector which is capable to install under sea water at higher depths over a wide range of hydrostatic pressure.

Yet another objective of the present invention is to provide an acoustic energy reflector devoid of water absorption and having perfect acoustically reflecting surfaces.

Yet another objective of the present invention is to provide an underwater acoustic reflector, which is capable to fabricate in any geometric shape to suit any requirement.

Yet another objective of the present invention is to acoustic energy reflector having high efficiency reflecting surfaces, whereby all reflected energy is directed toward the target or user wherever positioned relative to the reflector.

SUMMARY OF THE INVENTION

The present invention relates to an acoustic energy reflector. More particularly, the said acoustic energy reflector generates, radiates and receives acoustic energy at various frequencies, particularly in sonar applications. The acoustic energy reflector of the invention comprises a core of microcellular rubber and a fiber reinforced composite shell. The mechanism of reflection of acoustic energy is a result of the acoustic impedance mismatch between the air cavities of the cellular foam and surrounding water medium. In the present invention, acoustic energy reflector is capable to manufacture to any shape and capable to attach with reflecting surfaces along with acoustic transducers whereby the acoustic radiation emanating or receiving there from is mostly only from one side, so that the transducer may be utilized as a directional transducer. The advantage of the invention lies in achieving directionality of the transducer, sustaining wide range of hydrostatic pressure and preventing water absorption.

DETAIL DESCRIPTION OF THE INVENTION

Figure 1:
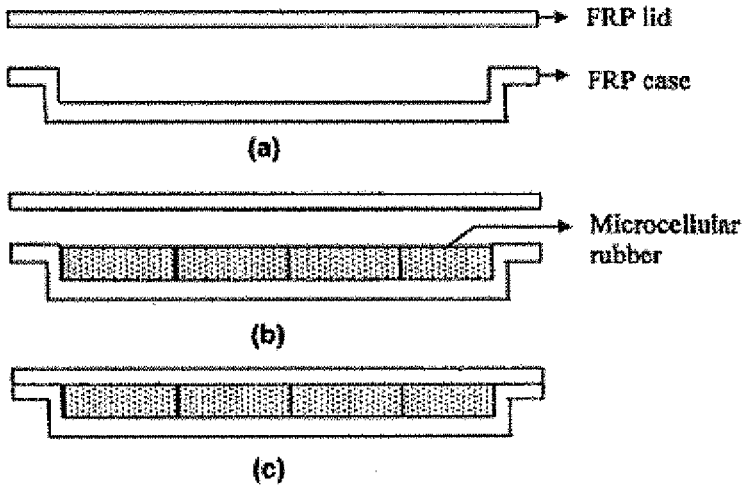
FIG. 1 is a schematic, exploded view of the top and bottom plates of the FRP easing, (a) before insertion of microcellular rubber, (b) with microcellular rubber pieces packed and (c) after closure.

Accordingly, the present invention relates to an acoustic energy reflector comprising a microcellular rubber as inner liner and a fiber reinforced composite as outer casing, in a core-shell assembly, wherein the said microcellular rubber is selected from the group of natural and synthetic rubbers having glass transition temperature below 0° C. and the resin for the fiber reinforced composite is selected from a group having a glass transition temperature at least 50° C.

One aspect of the present invention wherein the said inner liner composition comprises about 65 to 85% rubber, about 5 to 30% carbon black filler, about 1 to 4% accelerator; 0.5 to 4% activator, 0.5 to 4% of vulcanizing agents e.g. sulfur, zinc oxide, peroxide or a blend thereof; 0.5 to 8% of foaming agent, 0 to 10% processing oil.

Another aspect of the present invention, wherein outer casing composition comprising about 75 to 95% thermoset resin and 5 to 25% glass fiber.

Yet another aspect of the present invention, wherein the rubber for the microcellular inner is selected from the range of polychloroprene rubber, natural rubber, styrene butadiene rubber, nitrile rubber, polyurethane rubber, ethylene propylene rubber or ethylene propylene diene monomer rubber.

Yet another aspect of the present invention, wherein the blowing agents are selected from the group comprising azodicarbonamide, dinitrosopentamethylene tetramine or sodium bicarbonate in appropriate quantities.

Yet another aspect of the present invention, wherein the resin for the fiber reinforced composite is selected from a group consisting of polyesters, vinyl esters or epoxies or combination thereof.

Yet another aspect of the present invention, wherein the said fibers is selected from a group of glass fiber, silica fiber, Kevlar fiber, or in combination thereof.

Yet another aspect of the present invention, wherein the said fibers are selected from any sizes and shapes, preferably short fibers of 0.1 mm to 3 mm and for long fibers 3 mm to 15 mm.

Yet another aspect of the present invention, wherein the said reflector is optionally combined as an attachment to any transducer set up to make the transducer directional while generating, radiating or receiving acoustic energy at various frequencies in sonar applications.

Yet another aspect of the present invention, wherein the said reflector is capable to sustain a wide range of hydrostatic pressure with minimum water absorption with an acoustically reflecting surface.

Yet another aspect of the present invention, wherein the said composite acoustic reflector is capable to make in any geometric shape.

Yet another aspect of the present invention, wherein the rubber liner alone or in the composite casing has excellent reflector of acoustic energy.

Yet another aspect of the present invention, wherein the said reflector is suitable for applications in acoustic lens and acoustic amplifier.

The present invention relates to an acoustic energy reflector. More particularly, the said acoustic energy reflector generates, radiates and receives acoustic energy at various frequencies, particularly in sonar applications. The acoustic energy reflector of the invention comprises a core of microcellular rubber and a fiber reinforced composite shell. The said core of micro cellular rubber is manufactured by single or multilayer of natural or synthetic rubber or in combination thereof. The mechanism of reflection of acoustic energy is a result of the acoustic impedance mismatch between the air cavities of the cellular foam and surrounding water medium. In the present invention, acoustic energy reflector is capable to manufacture to any shape and capable to attach with reflecting surfaces along with acoustic transducers whereby the acoustic radiation emanating or receiving there from is mostly only from one side, so that the transducer may be utilized as a directional transducer. The advantage of the invention lies in achieving directionality of the transducer, sustaining wide range of hydrostatic pressure and preventing water absorption.

The present invention relates to composite acoustic reflector for directional underwater transducers. Essentially, the composite reflector comprises a microcellular rubber core and a glass fiber reinforced composite casing. The following non-limiting examples are set to illustrate the present invention.

The composition of the microcellular rubber consists a major amount of at least one rubber mixed with effective amounts of filler, a set of activator-accelerator-vulcanizing agent chemicals, foaming agent and preferably processing oil. More specifically, the composition comprises about 65 to 85%, and preferably 70 to 80%, of a rubber, e.g., polychloroprene (CR), cis-polyisoprene (natural rubber or NR), poly (styrene-co-butadiene) rubber (SBR) or any such rubbers with a glass transition temperature below 0° C. or a blend thereof; about 5 to 30%, and preferably 10 to 20%, of a carbon black filler e.g., furnace or thermal carbon blacks or a blend thereof; about 1 to 4% of accelerator e.g. thiazole, sulphenamide, thiourea class of accelerators or a blend thereof; 0.5 to 4% of activator e.g. zinc oxide, stearic acid, magnesium oxide, cyanurate or a blend thereof; 0.5 to 4% of vulcanizing agents e.g. sulphur, zinc oxide, peroxide or a blend thereof; 0.5 to 8% of foaming agent e.g. azocarbonamide, dinitrosopentamethylene tetramine or sodium bicarbonate; and 0 to 10%, and preferably 3 to 7%, of aromatic oil, naphthenic oil or a blend thereof as processing oil. Other process aids which do not destroy or interfere with the desired characteristics may be added in effective amounts including such materials as clay, wax, antioxidants, etc. as may be apparent to experienced practitioners in the field. The composite used in the casing or shell consists of at least one thermoset mixed with effective amounts of a glass fiber. More specifically, the composition comprises about 75 to 95%, and preferably 84 to 92%, of a thermoset resin with glass transition above 50° C. preferably from the polyesters, vinyl esters or epoxy family; and 5 to 25%, and preferably 8 to 16%, of glass fiber from the group of E-glass or S-glass in chopped strand or mat form. Other process aids which do not destroy or interfere with the desired characteristics may be added in effective amounts including such materials as antioxidants.

In a preferred embodiment, the composite is cast in a mold into the required geometrical shape, in which the microcellular material is packed and sealed thereafter. Thus obtained reflector, consisting of the inner microcellular rubber and the outer casing—in a core shell fashion—can be fixed using nut and bolt on to any surfaces as the case may be, as further explained in the following working example.

The acoustic reflector can focus acoustic energy to a point which can have applications like acoustic lens and acoustic amplifier also and which can be modified appropriately to suitable applications utilizing transducers in air also.

WORKING EXAMPLES

In a preferred embodiment for the making the microcellular rubber, 1000 g of SBR was masticated in a two-roll mill for 5 minutes followed by the addition of 50 g of zinc oxide (specific gravity 5.5), 2 g of stearic acid (melting point 70° C.) and 300 g of high abrasion furnace carbon black (iodine absorption 82 mg/g). The mixing was continued for another 10 minutes, during which 75 g aromatic oil (rubber grade), viscosity 250 cPs) and 20 g polymerized 2,2,4-trimethyl-1,2 dihydroquinone were added in small quantities. The rubber compound was allowed to cool to ambient temperature. The mixing was resumed with the addition of 20 g of azodicarbonamide. This was followed by the addition of 8 g N-cyclohexyl-2-benzothiazyole sulphenamide (melting point 105° C.) and 1 g of mercaptobenzothiazole (melting point 180° C.). After thorough mixing, the compound was again allowed to cool after which it was mixed again with 20 g of sulphur. The whole compound was passed through zero nip for at least five times. The compound was then sheeted out as 0.5 to 3 mm thick sheet. The sheet was then placed appropriately filled in a closed mould with a cavity of 150 mm×150 mm×6 mm. The mould was preheated at 140° C. to 180° C., preferably 160° C. in a hydraulic press. The curing of the compound was then carried out for 10 to 30 minutes, preferably with less than 10 MPa pressure in the press. The mould was then taken out, cooled for 5 minutes and subsequently opened to take out of the foamed rubber piece. It was kept in ambient condition for 24 hours before further use.

In a further preferred embodiment for the production of the composite casing, 1000 g of isophthalic based polyester resin containing 46-50% styrene and with a specific gravity of 1.07 was mixed with glass fiber (chopped strand mat, 20 g per square foot) and 1.25% curing agent. The resin-fiber mixture was cast in the desired mold and allowed to cure overnight. Post curing was carried out for 2 hr at 125° C.

Though there many preferred embodiments, the following working example illustrates the fabrication of a composite shell reflector for the use with a typical underwater acoustic transducer used as low frequency, high energy projectors.

In this working example, the composite was cast into two pieces as shown in FIG. 1 (*a*), one being a box like casing and the other a lid. The microcellular rubber pieces as molded above were packed into the box (FIG. 1*b*) and sealed hermetically with the lid using the same composite mixture (FIG. 1*c*).

Figure 2:
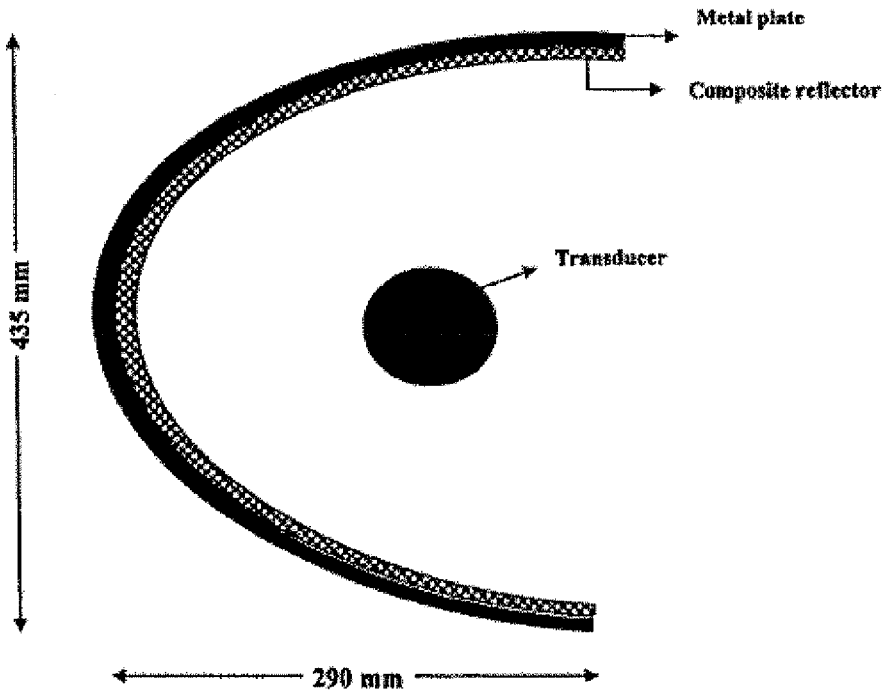
FIG. 2 is the schematic of the test set up showing the layout of the acoustic transducer, and the composite reflector fitted on the inner side of the metal parabolic reflector frame.
Figure 3:
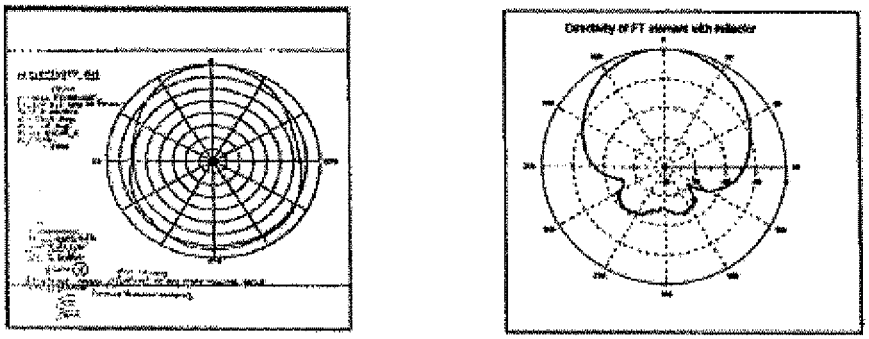
FIG. 3 is the plot of directivity pattern of transducer (a) alone and (b) with the composite reflector set up.
Figure 4A:
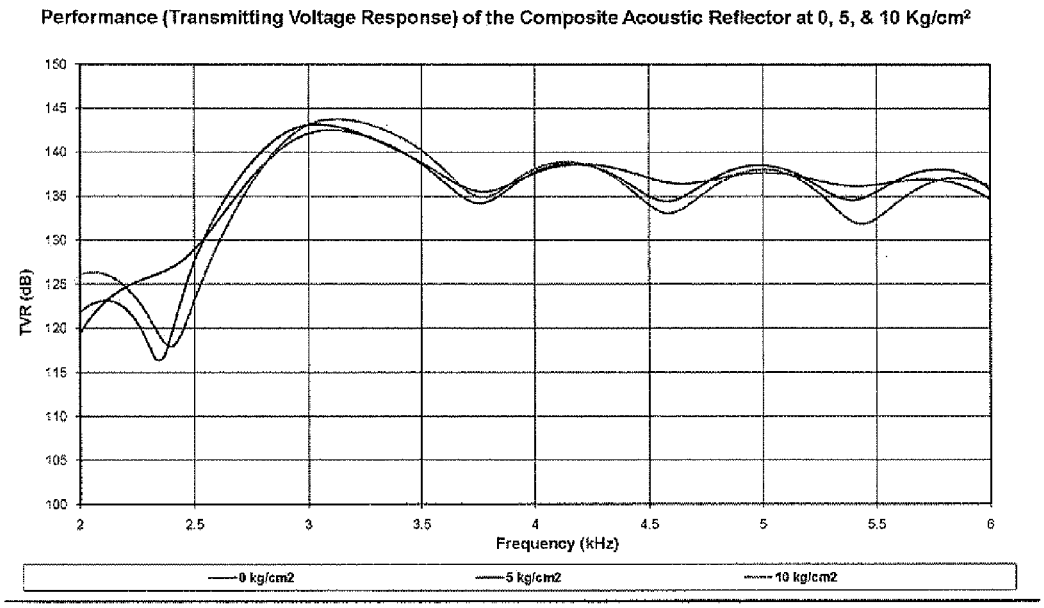
FIG. 4 (*a* to *d*) shows the transmitted voltage response (TVR) of the acoustic energy reflector at various pressures, according to the present invention.
Figure 4B:
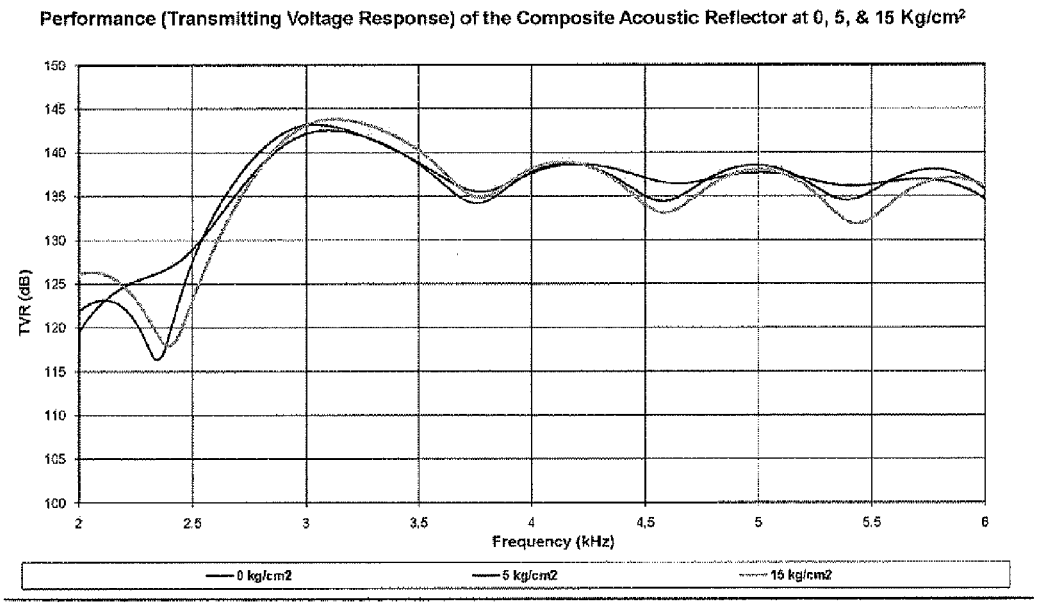
Figure 4C:
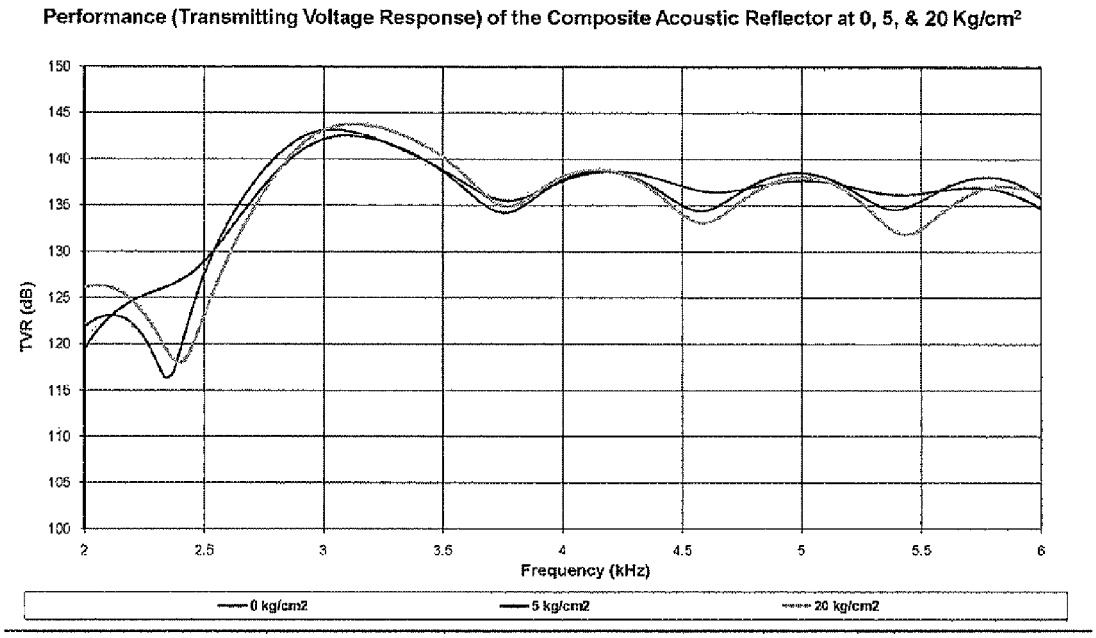
Figure 4D:
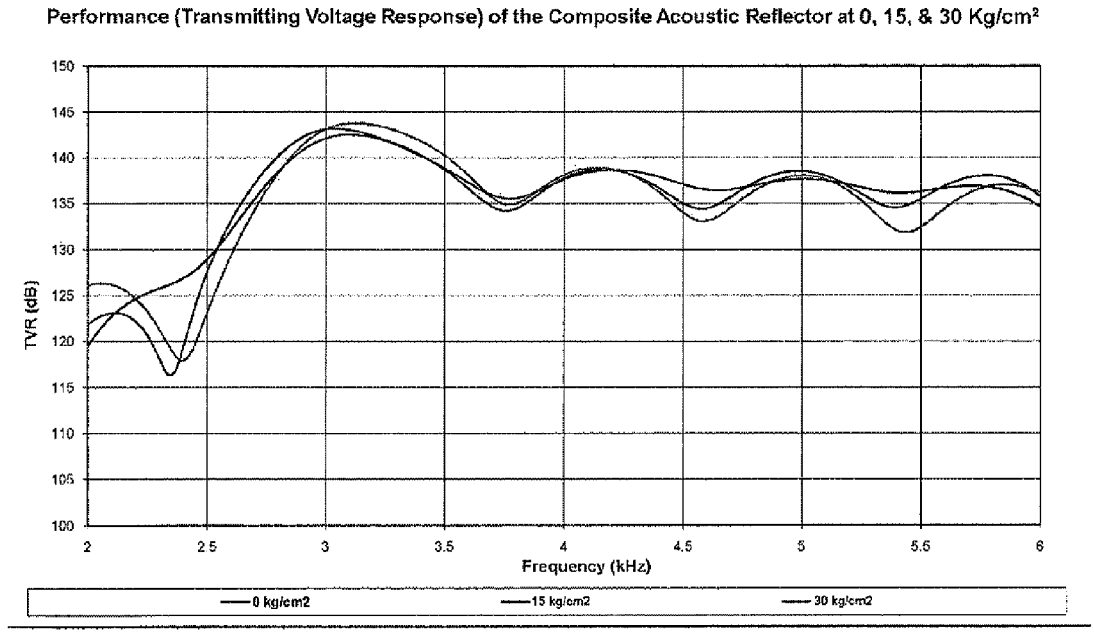

In order to illustrate the efficacy and efficiency of the composite reflector, a test setup was made as shown in FIG. 2 using the transducer and a parabolic metallic structure. First the directivity was measured underwater with the transducer alone. Then, the composite reflector was tightly snug fit into the metallic reflector using nuts and bolts; the transducer being fixed at the focal point of the reflector and the test was repeated. The results are shown in FIGS. 3(*a*) and (*b*), which clearly indicate that the omni directional transducer becomes perfectly directional with the composite reflector in place.

Further, the said acoustic energy reflector was tested by installing the same at different level under sea water, i.e. at various hydrostatic pressure conditions. It is found after experiments that the said acoustic energy reflector can be installed up to 300 meter depth in the water, and it can sustain pressure up to 25 to 35 kg/cm2. It is found that the transmitted voltage response (TVR) of the said accosting energy reflector at various hydrostatic pressure (i.e. various depth) 0, 5, 10, 15, 25, 30 kg/cm2, remain unchanged. as shown in the FIGS. 4*a*, 4*b*, 4*c* and 4*d* which can interpreted by superimposing lines in the FIG. 4.

ADVANTAGES OF THE INVENTION

The acoustic energy reflector is capable to generate, radiate and receive acoustic energy at various frequencies.

The acoustic energy reflector is capable to install under sea water at higher depths over a wide range of hydrostatic pressure.

The acoustic energy reflector is devoid of water absorption and having perfect acoustically reflecting surfaces.

The acoustic energy reflector is capable to fabricate in any geometric shape to suit any requirement.

The acoustic energy reflector is having high efficiency reflecting surfaces, whereby all reflected energy is directed toward the target or user wherever positioned relative to the reflector.

While this invention has been described in terms of a preferred embodiment, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

We claim:

1. An acoustic energy reflector comprising a microcellular rubber as inner liner and a fiber reinforced composite as outer casing, in a core-shell assembly, wherein the said microcellular rubber is selected from the group of natural and synthetic rubbers having glass transition temperature below 0° C. and the resin for the fiber reinforced composite is selected from a group having a glass transition temperature at least 50° C.

2. The acoustic energy reflector as claimed in claim 1, wherein the said inner liner composition comprises about 65 to 85% rubber, about 5 to 30% carbon black filler, about 1 to 4% accelerator; 0.5 to 4% activator, 0.5 to 4% of vulcanizing agents e.g. sulfur, zinc oxide, peroxide or a blend thereof; 0.5 to 8% of foaming agent, 0 to 10% processing oil.

3. The acoustic energy reflector as claimed in claim 1, wherein the said inner liner is manufactured by single or multilayer of natural or synthetic rubber or in combination thereof.

4. The acoustic energy reflector as claimed in claim 1, wherein outer casing composition comprising about 75 to 95% thermoset resin and 5 to 25% glass fiber.

5. The acoustic energy reflector as claimed in claim 1, wherein the rubber for the microcellular inner is selected from the range of polychloroprene rubber, natural rubber, styrene butadiene rubber, nitrile rubber, polyurethane rubber, ethylene propylene rubber or ethylene propylene diene monomer rubber.

6. The acoustic energy reflector as claimed in claim 2, wherein the blowing agents are selected from the group comprising azodicarbonamide, dinitrosopentamethylene tetramine or sodium bicarbonate in appropriate quantities.

7. The acoustic energy reflector as claimed in claim 4, wherein the resin for the fiber reinforced composite is selected from a group consisting of polyesters, vinyl esters or epoxies or combination thereof.

8. The acoustic energy reflector as claimed in claim 1, wherein the said fibers is selected from a group of glass fiber, silica fiber, Kevlar fiber, or in combination thereof.

9. The acoustic energy reflector as claimed in claim 8, wherein the said fibers are selected from any sizes and shapes.

10. The acoustic energy reflector as claimed in claim 1, wherein the said reflector is optionally combined as an attachment to any transducer set up to make the transducer directional while generating, radiating or receiving acoustic energy at various frequencies in sonar applications.

11. The acoustic energy reflector as claimed in claim 1, wherein the said reflector is capable to sustain a wide range of hydrostatic pressure with minimum water absorption with an acoustically reflecting surface.

12. The acoustic energy reflector as claimed in claim 1, wherein the said composite acoustic reflector is capable to make in any geometric shape.

13. The acoustic energy reflector as claimed in claim 1, wherein the rubber liner alone or in the composite casing has excellent reflector of acoustic energy.

14. The acoustic energy reflector as claimed in claim 1, is suitable for applications like acoustic lens and acoustic amplifier.

15. The acoustic energy reflector as claimed in claim 2, wherein the said inner liner is manufactured by single or multilayer of natural or synthetic rubber or in combination thereof.

16. The acoustic energy reflector as claimed in claim 2, wherein the rubber for the microcellular inner is selected from the range of polychloroprene rubber, natural rubber, styrene butadiene rubber, nitrile rubber, polyurethane rubber, ethylene propylene rubber or ethylene propylene diene monomer rubber.

* * * * *